US011053723B2

(12) United States Patent
Sobolewski et al.

(10) Patent No.: US 11,053,723 B2
(45) Date of Patent: Jul. 6, 2021

(54) FLAP FITTING AND ITEM OF FURNITURE

(71) Applicant: HETTICH-ONI GMBH & CO. KG, Vlotho (DE)

(72) Inventors: Uwe Sobolewski, Bünde (DE); Stefan Andschus, Lübbecke (DE); Michael Tasche, Bielefeld (DE); Oliver Schael, Kirchlengern (DE)

(73) Assignee: HETTICH-ONI GMBH & CO. KG, Vlotho (DE)

( * ) Notice: Subject to any disclaimer, the term of this patent is extended or adjusted under 35 U.S.C. 154(b) by 14 days.

(21) Appl. No.: 16/628,145

(22) PCT Filed: Jun. 26, 2018

(86) PCT No.: PCT/EP2018/067147
§ 371 (c)(1),
(2) Date: Jan. 2, 2020

(87) PCT Pub. No.: WO2019/007760
PCT Pub. Date: Jan. 10, 2019

(65) Prior Publication Data

US 2020/0131829 A1 Apr. 30, 2020

(30) Foreign Application Priority Data

Jul. 3, 2017 (DE) ..... 10 2017 114 772.1

(51) Int. Cl.
*E05F 1/08* (2006.01)
*E05F 3/20* (2006.01)
*E05F 3/18* (2006.01)

(52) U.S. Cl.
CPC ..... *E05F 3/20* (2013.01); *E05F 3/18* (2013.01); *E05Y 2201/212* (2013.01); *E05Y 2201/604* (2013.01); *E05Y 2900/20* (2013.01)

(58) Field of Classification Search
CPC ... E05F 1/08; E05F 1/10; E05F 1/1041; E05F 1/1091; E05F 1/12; E05F 1/1223;
(Continued)

(56) References Cited

U.S. PATENT DOCUMENTS 2,626,420 A * 1/1953 Mongin ..... E05F 1/1269 16/79
4,283,029 A * 8/1981 Rudolph ..... B64C 9/18 244/215

(Continued)

FOREIGN PATENT DOCUMENTS

DE 2646371 A1 4/1978
DE 10047978 A1 4/2002

(Continued)

OTHER PUBLICATIONS

International Search Report dated Oct. 5, 2018 in related/corresponding International Application No. PCT/EP2018/067147.

(Continued)

*Primary Examiner* — Chuck Y Mah
(74) *Attorney, Agent, or Firm* — Patent Portfolio Builders PLLC

(57) ABSTRACT

A flap fitting for furniture having a housing secured to a body. A support lever is rotatably mounted on the housing about a first axis of rotation. The support lever is connected to a flap about a second axis of rotation using a connection. A control lever is connected via the connection to the flap about a third axis of rotation. The control lever is articulatedly connected about a fourth axis of rotation to a control element and to the housing. The flap is pivotable via a gripping element. A center of rotation of the flap when in a closed position is located below the gripping element and (Continued)

when in a maximum open position is located above the gripping element. As a result the flap can be smoothly opened and closed by a user.

20 Claims, 16 Drawing Sheets

(58) Field of Classification Search
CPC ..... E05F 1/1246; E05F 1/1253; E05F 1/1261; E05F 1/1292; E05F 1/14; E05F 3/20; E05F 3/18; E05D 11/021; E05D 3/12; E05D 3/14; E05D 3/16; E05D 11/1021; E05D 15/40; E05D 15/401; E05D 15/405; E05D 15/406; E05D 15/42; E05D 15/58; E05D 15/565; E06B 3/5045; E05Y 2800/22; E05Y 2900/20; E05Y 2900/202; E05Y 2900/208; E05Y 2900/21; E05Y 2201/21; E05Y 2201/264; E05Y 2201/212; E05Y 2201/604
See application file for complete search history.

(56) References Cited

U.S. PATENT DOCUMENTS 4,383,347 A * 5/1983 La Conte ..... B64D 11/003 16/360
7,178,202 B2 * 2/2007 Hirtsiefer ..... E05F 1/1261 16/366
7,794,028 B2 * 9/2010 Brunnmayr ..... E05D 15/46 312/323
7,966,699 B2 * 6/2011 Dubach ..... E05D 7/123 16/386
8,468,653 B2 * 6/2013 Tumler ..... E05D 15/46 16/286
8,959,709 B2 * 2/2015 Hasegawa ..... E05F 1/1261 16/65
9,816,302 B2 * 11/2017 Shepherd ..... E05D 3/14
2001/0039762 A1 * 11/2001 Giovannetti ..... E05F 1/1091 49/246
2006/0174444 A1 * 8/2006 Giovannetti ..... E05D 15/262 16/354
2007/0124893 A1 * 6/2007 Brustle ..... E05F 5/02 16/296
2008/0121490 A1 * 5/2008 Dubach ..... E05F 5/00 192/17 D
2012/0084944 A1 * 4/2012 Hirtsiefer ..... E05D 3/14 16/302
2014/0319987 A1 * 10/2014 Blum ..... E05F 1/12 312/319.2

FOREIGN PATENT DOCUMENTS

EP 2138658 A1 12/2009
JP 2002038809 A * 2/2002
WO 2009060723 A1 5/2009
WO 2017093290 A1 6/2017

OTHER PUBLICATIONS

Search Report created on Jun. 26, 2018 in related/corresponding DE Application No. 10 2017 114 772.1.
Written Opinion dated Oct. 5, 2018 in related/corresponding International Application No. PCT/EP2018/067147.

* cited by examiner

FLAP FITTING AND ITEM OF FURNITURE

BACKGROUND AND SUMMARY OF THE INVENTION

Exemplary embodiments of the present invention relate to a flap fitting, in particular for an item of furniture, having a housing, which is fixable on a body, and on which a supporting lever is rotatably mounted around a first axis of rotation, and the supporting lever is connectable to a flap via a second axis of rotation using an attachment, and a control lever, which is connectable to the flap via a third axis of rotation via the attachment, wherein the control lever is articulated via a fourth axis of rotation with a control element and the housing, and the flap is pivotable via a handle element.

WO 2009/060723 A1 discloses an item of furniture having a flap fitting, in which a housing plate is fixed on a furniture body, on which a supporting lever and a control arm are rotatably mounted. The supporting lever and the control arm are furthermore rotatably mounted on an attachment on the flap, so that a parallelogram-type guide is provided between the body and the flap. It is disadvantageous in this flap fitting that the axis of rotation on the supporting lever and the control lever are provided on fixed points of the housing plates or the attachment, so that to achieve the desired pivot movement of the flap having an open position protruding upward and forward into the room, the pivot points on the housing plate have to be comparatively far away from one another, which is counter to the requirement for a compact construction. Moreover, the actuation of the flap fitting is comparatively sluggish.

Accordingly, exemplary embodiments of the present invention are directed to a flap fitting that is compactly constructed and enables smooth opening and closing of the flap for the user.

In the flap fitting according to the invention, an instantaneous center of rotation of the flap is located below the handle element in a closed position and is located above the handle element in a maximally open position. In this case, only the supporting lever is connected in a stationary manner to a housing via a first axis of rotation, while the control lever is articulated on the housing via a control element, so that the fourth axis of rotation moves in relation to the housing during an opening or closing movement. A movement path of the flap can thus be set optimally, and the application of force can be minimized for the user.

The instantaneous center of rotation is, in the case of a planar movement of a rigid body, the point in space around which the body can be considered to solely rotate at the moment. In the case of a planar movement of a rigid body having a translational movement and a rotational movement, these are combined to form a solely rotational movement around the instantaneous pivot point, which is referred to as the instantaneous center of rotation.

During the movement of the flap, the instantaneous center of rotation changes further in each acquired position. If one ascertains these positions, a path on which the instantaneous center of rotation runs results in relation to a spatially-fixed reference system, in the present case to the stationary body. The instantaneous center of rotation can be ascertained for any arbitrary point of the flap or also for points of other components connected to the flap. In the proposed technical solution, it is preferable to determine the instantaneous center of rotation proceeding from the second and third axis of rotation, which are arranged on the attachment of the flap.

The flap movement is preferably determined in the respective observed snapshot by the first connecting line of the first to the second axis of rotation and the second connecting line of the fourth to the third axis of rotation, which in principle represents a four-bar linkage. The first connecting line of the first to the second axis of rotation represents the force action line of the supporting lever in this case, while the second connecting line of the fourth to the third axis of rotation represents the force action line of the control lever. The intersection point of the extensions of the first and second connecting line results in the location of the instantaneous center of rotation.

The path of the instantaneous center of rotation of the flap preferably extends spaced apart from the handle element during an opening movement of the flap. Jamming at the joint axes can occur as a result of tolerances, particularly if the instantaneous center of rotation and the handle element are excessively close together. The distance of the path of the instantaneous center of rotation from the handle element can therefore correspond, for example, to at least 20% of the length of the supporting lever, preferably at least 40% of the length of the supporting lever. In one advantageous design, the distance of the instantaneous center of rotation from the handle element in the closed position of the flap is greater than the length of the supporting lever.

For a smooth pivot, the distance of the instantaneous center of rotation from the handle element over the entire path of the instantaneous center of rotation can be at least 50%, in particular at least 70%, of the distance of the handle element from the first axis of rotation.

The path of the instantaneous center of rotation can initially extend upward in a curve during an opening movement of the flap and can sink again shortly before reaching the maximally open position. The flap may thus be easily fixed in the maximally open position, in particular if the instantaneous center of rotation is displaced in the direction of the first axis of rotation of the supporting lever shortly before reaching the maximally open position.

In one design, the control element for the control lever is formed as a gear wheel. The gear wheel can be engaged with a further gear wheel in this case, which is non-rotationally arranged with the supporting lever around the first axis of rotation. The further gear wheel and the gear wheel, which is articulated with the control lever, are then driven via a pivot of the supporting lever, so that an exact movement of the control lever is predetermined. Instead of a gear wheel, the control element can also be formed as a further lever, wherein the formation as a gear wheel has the advantage that it can be driven by a further gear wheel.

A force accumulator is preferably provided, which pre-tensions the flap in a closed position in the closed setting and in an opening range in the open setting. The flap may thus be smoothly actuated by the user, since the user only initially has to overcome the force of the force accumulator when pivoting the flap out of the closed position, the force accumulator then assisting the user during the opening after overcoming a dead center, wherein it is also possible that the flap automatically pivots into an open position due to the force accumulator in a certain opening range. During the closing procedure, the force of the force accumulator has to be overcome until the force accumulator then pre-tensions the flap in the closing direction again. For easy operation, a handle element on the flap can be arranged below the flap and facing toward the user in the open state of the flap in this case.

BRIEF DESCRIPTION OF THE DRAWING FIGURES

The invention is explained in greater detail hereafter on the basis of an exemplary embodiment with reference to the appended drawings. In the figures.

DETAILED DESCRIPTION

Figure 1:
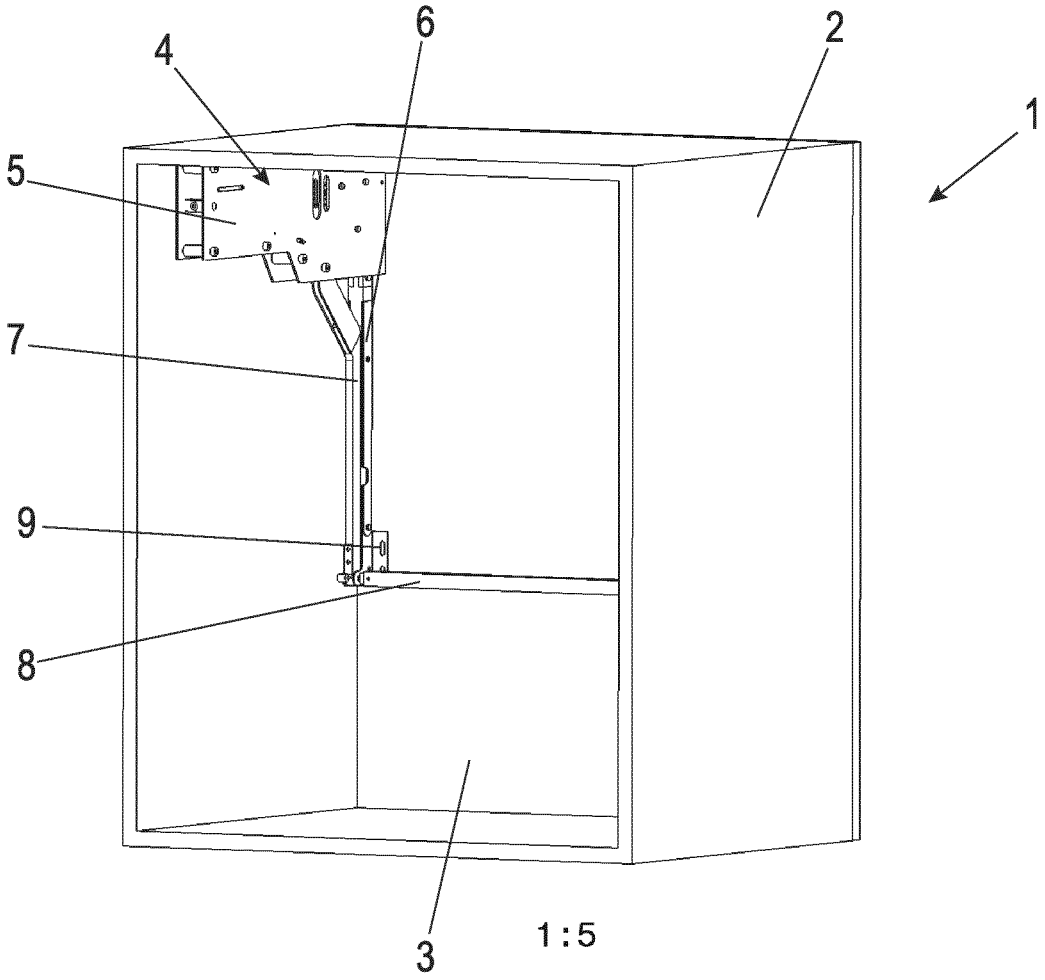
FIG. 1 shows a perspective view of an item of furniture according to the invention having a flap fitting.

An item of furniture 1 comprises a furniture body 2, for example, for a hanging cabinet in a kitchen, in which the rear wall was omitted in FIG. 1. The furniture body 2 is closed by a pivotably mounted flap 3 on a front side. A flap fitting 4, which comprises a housing 5, is installed in each case on opposing side walls of the furniture body 2 for guiding the flap 3. Each flap fitting 4 comprises a supporting lever 6 and a control lever 7, which are connected via an attachment 9 to the flap 3. The two attachments 9 of the opposing flap fittings 4 are synchronized via a rod 8, so that the flap fittings 4 are moved essentially synchronously during the opening and closing of the flap 3.

Figure 2:
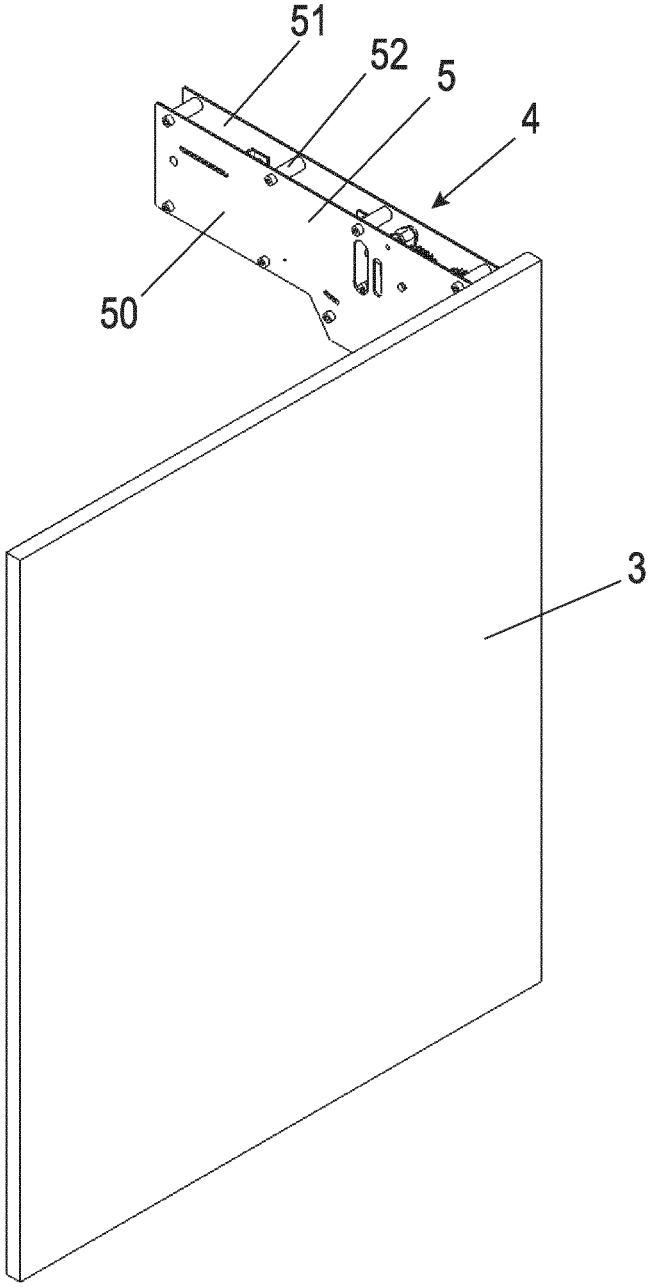
FIG. 2 shows a perspective view of the front panel having a flap fitting.

A flap fitting 4 having the flap 3 without furniture body 2 is shown in FIG. 2. The housing 5 of the flap fitting 4 comprises two side walls 50 and 51, which are arranged spaced apart from one another via a plurality of spacers 52. Other housing forms can also be used for the housing 5.

Figure 3A:
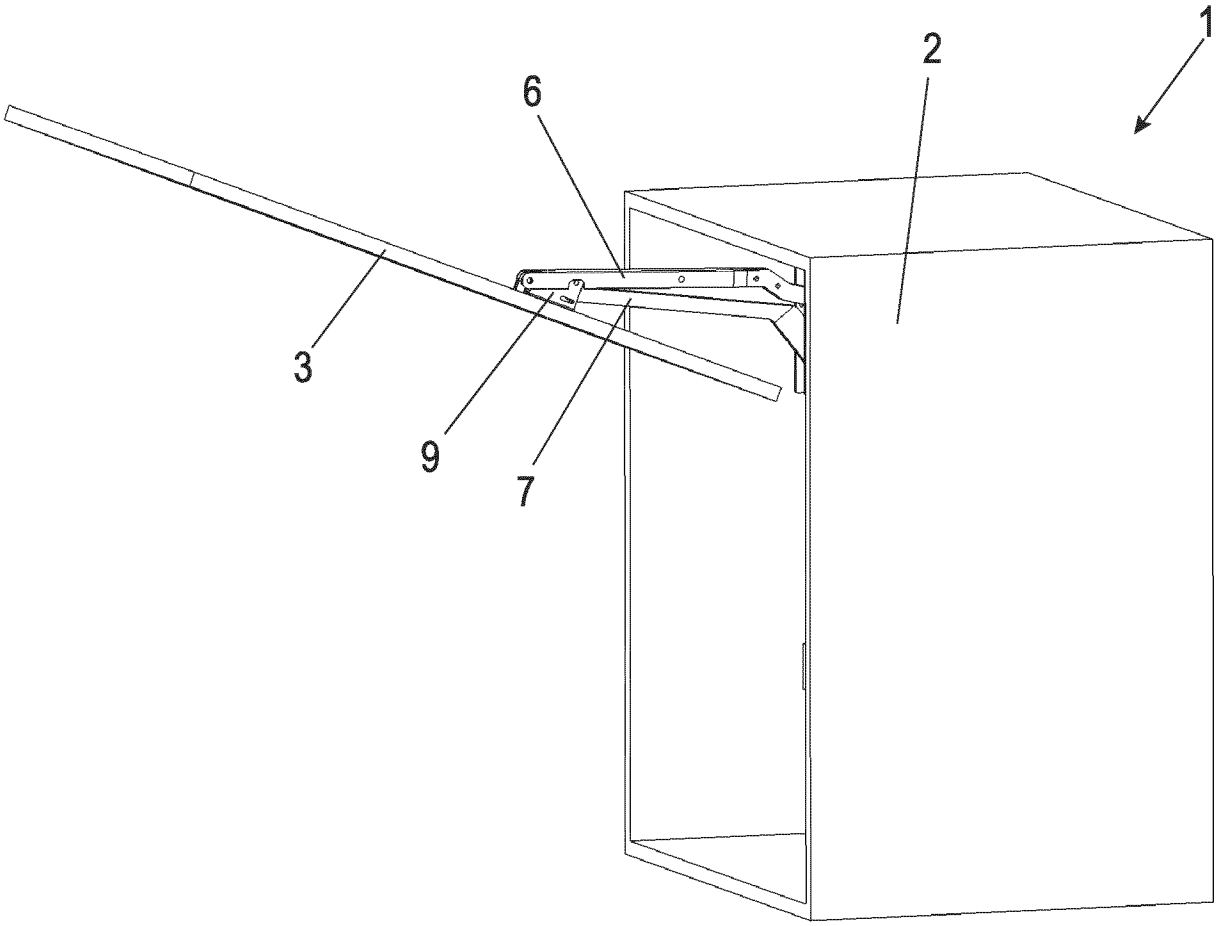
FIGS. 3A and 3B show two views of the item of furniture of FIG. 1 having an open flap.
Figure 3B:
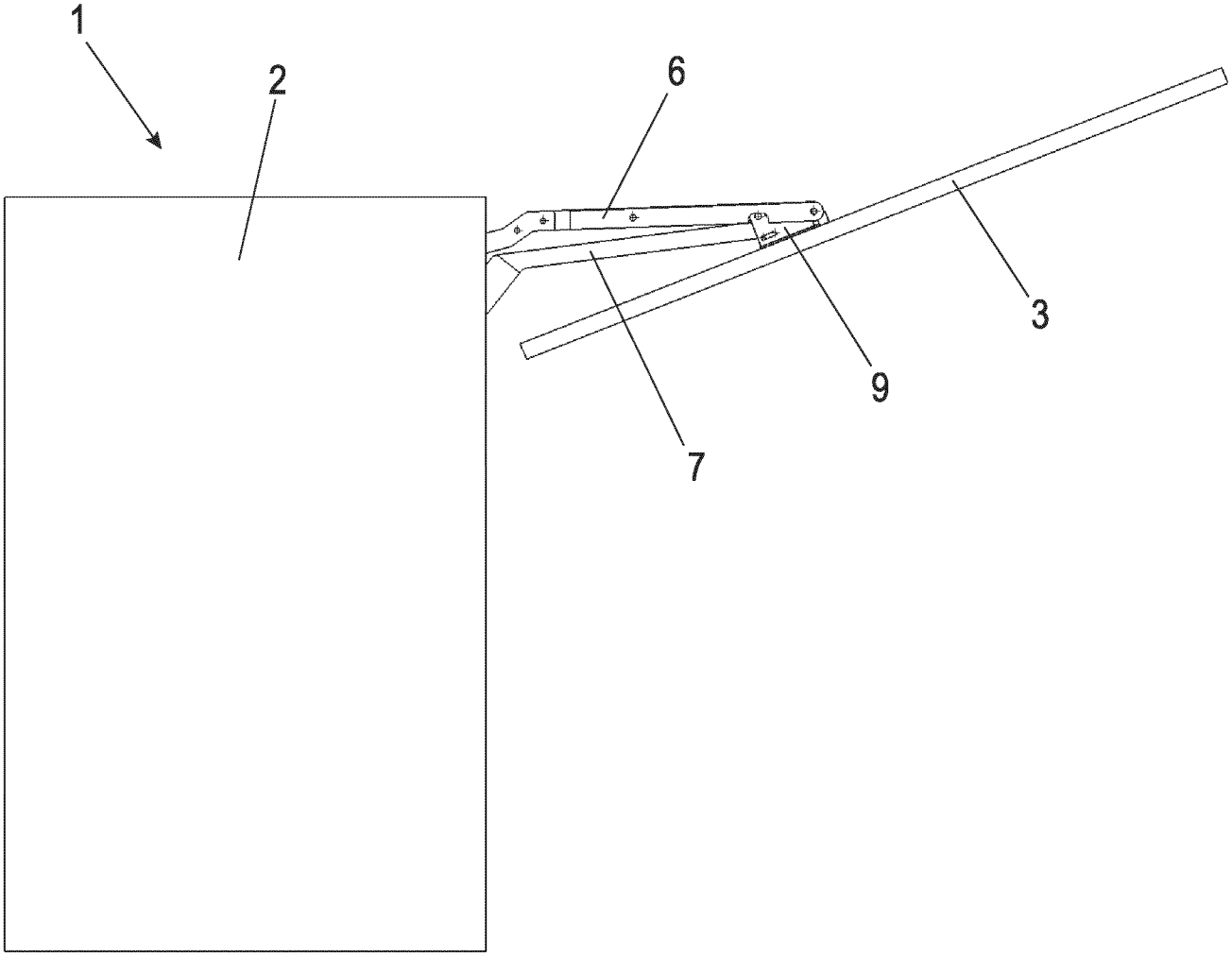

The flap 3 is shown in an open position in FIGS. 3A and 3B. The flap 3 has been pivoted with an upper region forward and away from the furniture body 2, while a lower region of the flap 3, on which a handle element (not shown) is installed, was pivoted essentially vertically upward. The user thus only has to execute a slight horizontal movement and essentially a vertical movement during the opening and closing of the flap 3.

Figure 4A:
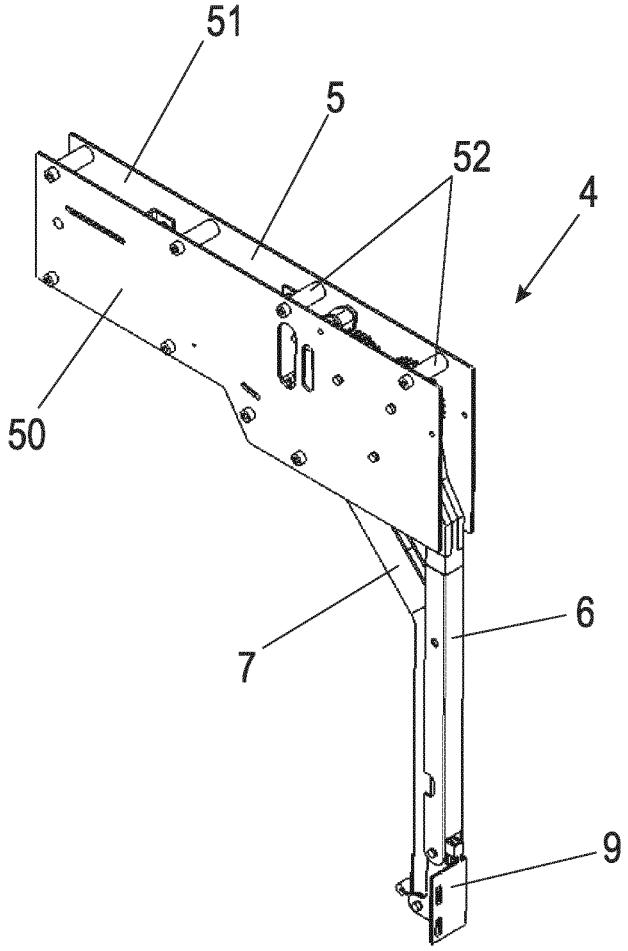
FIGS. 4A and 4B show two views of the pivot fitting in a closed position.
Figure 4B:
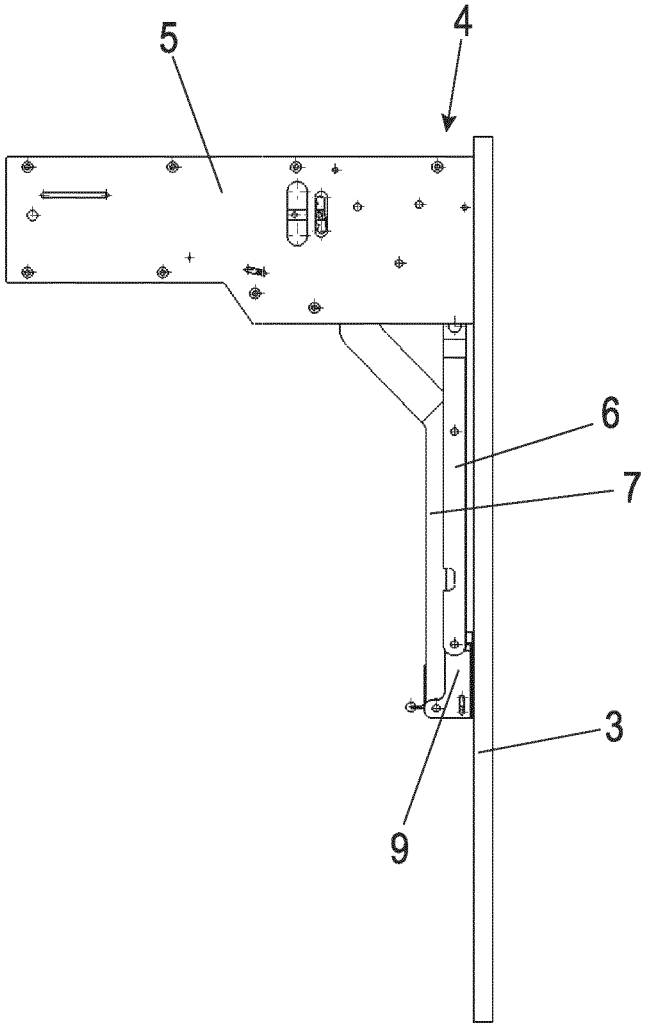

The flap fitting 4 is shown in a closed position in FIGS. 4A and 4B. The supporting lever 6 and the control lever 7 are arranged partially in parallel to one another and extend essentially in the vertical direction up to the attachment 9, which is installed on the flap 3.

Figure 5:
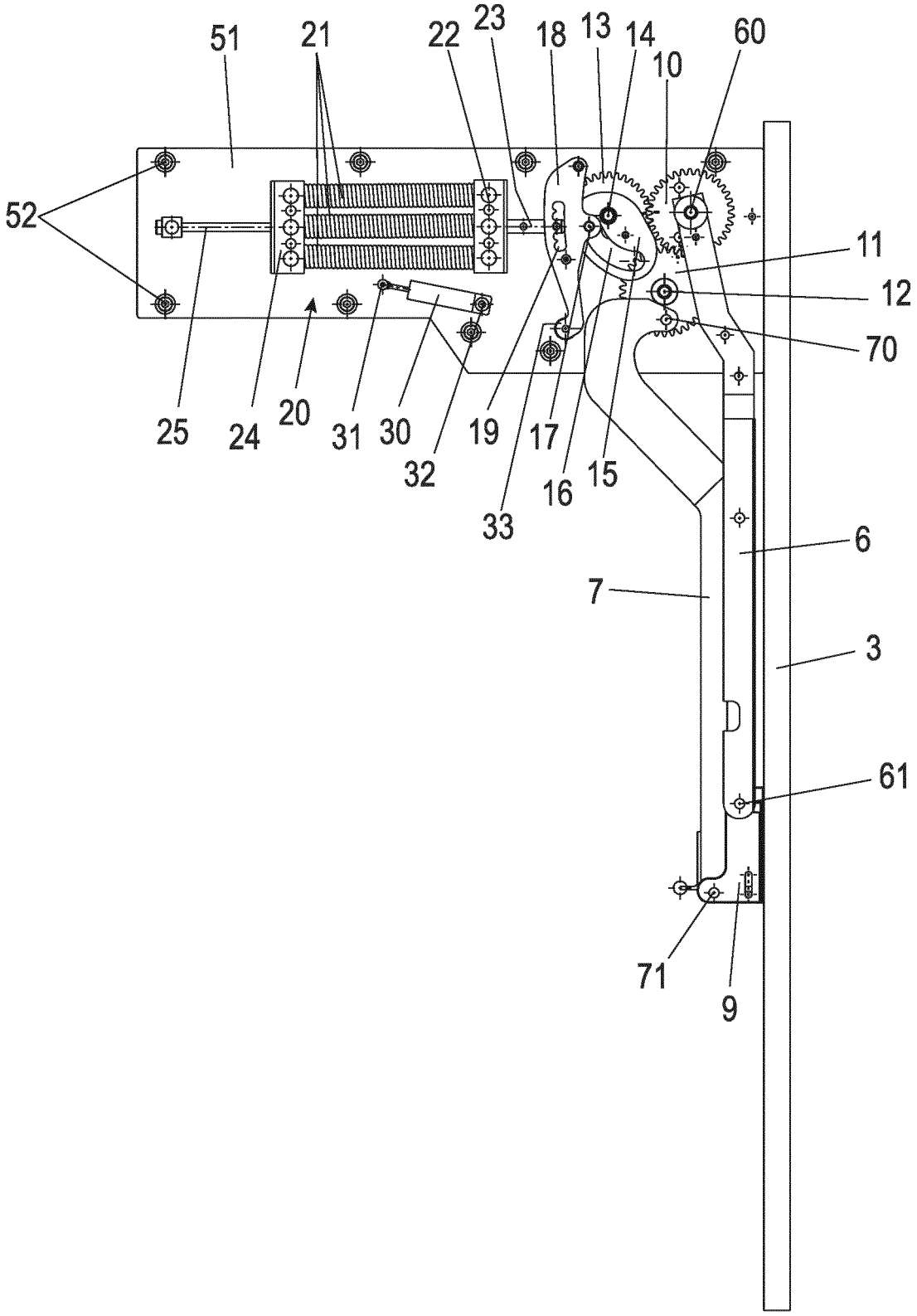
FIG. 5 shows a view of the pivot fitting having partially removed housing in a closed position.

In FIG. 5, the flap fitting 4 is shown in a closed position without the side wall 50 of the housing. The supporting lever 6 is articulated at one end around an axis of rotation 61 on the attachment 9 and on the opposing side around an axis of rotation 60, which is provided on the housing 5. A first gear wheel 10, which is engaged with a second gear wheel 11, which is mounted so it is rotatable around an axis of rotation 12 on the housing 5, is non-rotationally connected to the supporting lever 6 around the axis of rotation 60.

An axis of rotation 70, on which the control lever 7 is rotatably mounted, is provided on the second gear wheel 11 spaced apart from the axis of rotation 12 of the gear wheel 11. The control lever 7 is rotatably mounted around an axis of rotation 71 on the attachment 9 at the opposing end. The axis of rotation 70 thus moves during an opening and closing procedure of the flap 3, which is held on the attachment 9.

The attachment 9 can be formed both in one part and also multiple parts.

To partially compensate for the weight forces of the flap 3 during the opening and closing, a force accumulator 20 is provided, which comprises three springs 21, in particular traction springs in the illustrated exemplary embodiment, which are arranged between a first spring holder 22 and a second spring holder 24. The second spring holder 24 is fixed in this case via a fastening 25 on the housing 5. The spring holder 22 is connected via a rod 23 to a movable holder 18. A receptacle 19 is provided on the holder 18, on which the rod 23 of the force accumulator 20 is fixed, so that the holder 18 is pre-tensioned by the force accumulator 20. The holder 18 comprises a guide element 17, which is mounted in a curve guide 16 of a control disk 15. The control disk 15 is rotatably mounted around an axis of rotation 14 here, which is provided on the housing 5. Furthermore, the control disk 15 is non-rotationally coupled to a third gear wheel 13, which is engaged with the first gear wheel 10.

Various positioning options for the positioning of the rod 23 of the force accumulator 20 are formed on the receptacle 19 of the holder 18, so that an optimum presetting of the spring action to the weight forces of the flap 3 to be compensated for can already be performed by the selection of a suitable position. Instead of the positioning options, a continuous presetting can also be provided, for example, in the form of a screw/nut connection, by which the position of the rod 23 in relation to the holder 18 can be changed.

The term "gear wheel" is understood to mean rotating disks having external gear teeth, wherein the external gear teeth extend alternately over the entire circumference or only a part of the circumference. Alternatively, toothed segments, internal gear teeth, or other components can be used as gear wheels, on which teeth are provided for the formfitting engagement with an adjacent gear wheel.

Furthermore, a damper 30 is provided on the housing 5, which is formed as a linear damper, in particular as a fluid, liquid or air damper, which is held on a fastening element 31 on the housing 5 and comprises a piston-cylinder unit, which generates damping forces upon compression. On the side facing away from the fastening element 31, a contact surface 32 is provided, for example, a contact roller, which can be contacted by an actuating element 33 on the holder 18.

Figure 6:
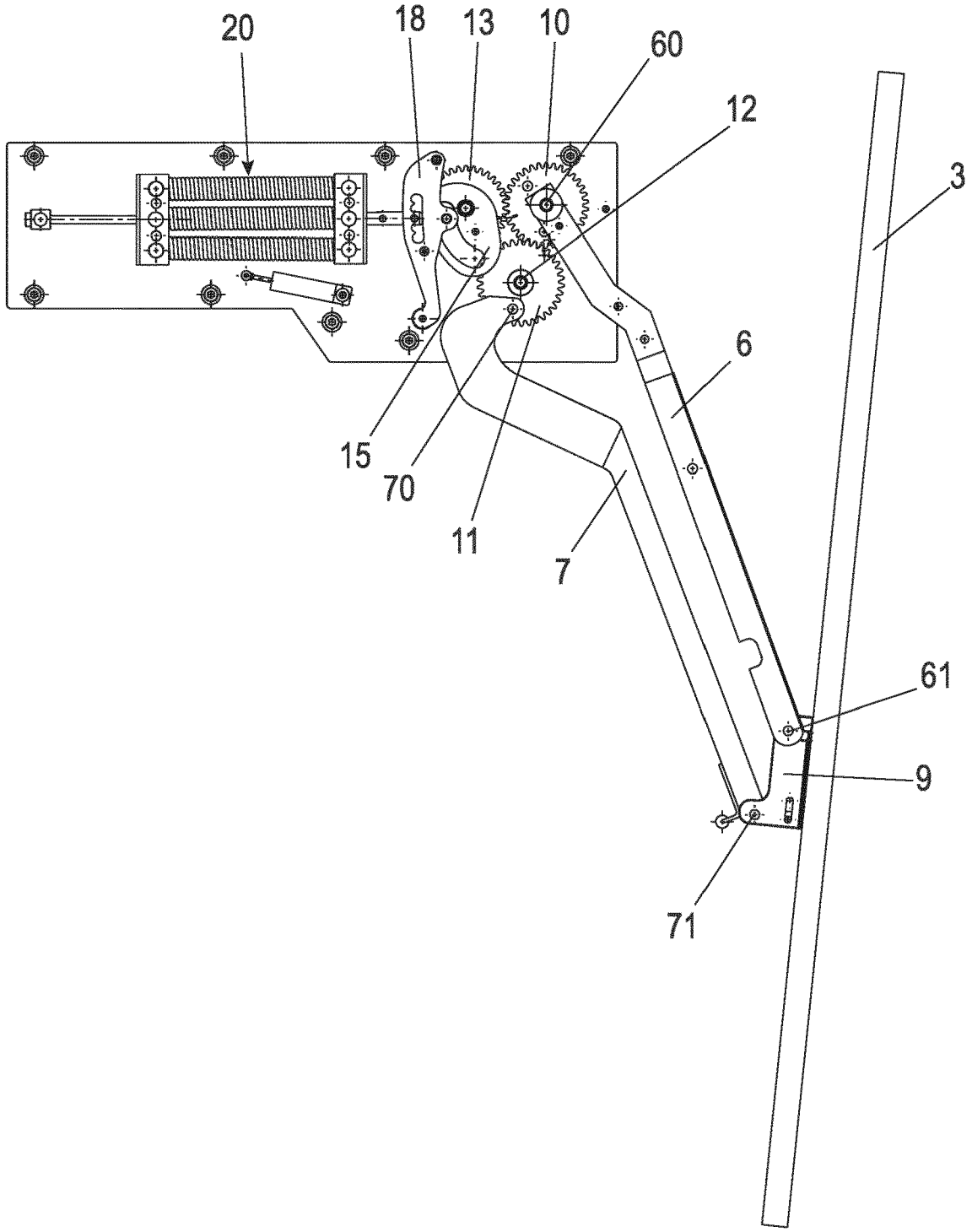
FIGS. 6 to 8 show multiple views of the flap fitting of the figure in different positions.

For an opening procedure, a handle arranged in the lower region of the flap 3 is actuated by a user to move the flap 3 forward and upward. The flap 3 is illustrated in a slightly open position in FIG. 6. The force accumulator 20 is further tensioned at the beginning of the opening movement, since the flap 3 is pre-tensioned in the closing direction in the range of the closed position. After overcoming a dead center, the force accumulator 20 assists the movement of the flap 3 in the opening direction.

Figure 7:
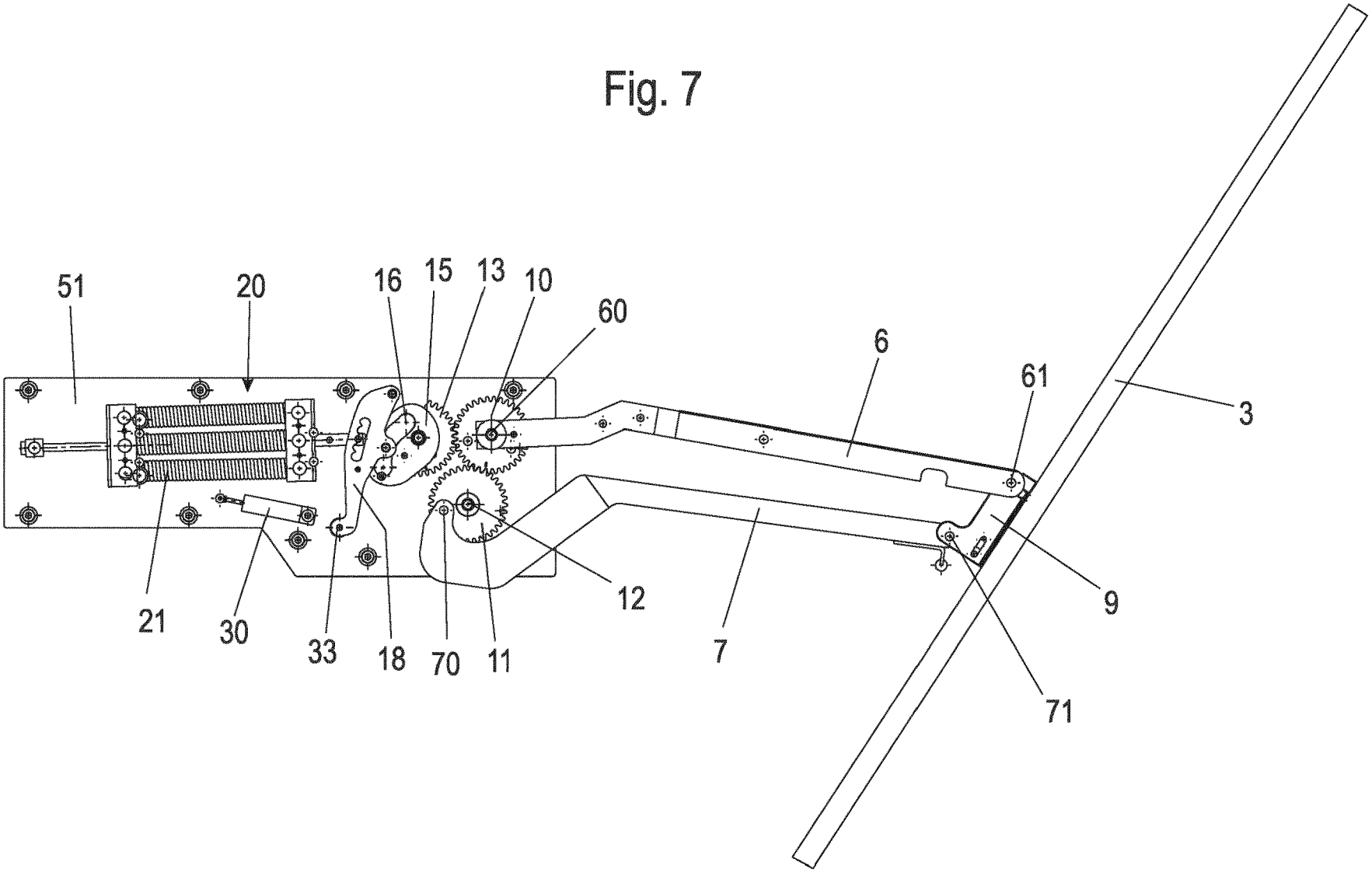

If the flap 3 is moved further in the opening direction, as shown in FIG. 7, both the supporting lever 6 pivots around the axis of rotation 60 and also the control lever 7 pivots around the axis of rotation 70, which is arranged on the rotatable gear wheel 11. From the closed position (FIG. 5) to the positioning FIG. 7, the gear wheel 11 was rotated by approximately 90°, so that the axis of rotation 70 has also been displaced. The gear wheels 10 and 11 are engaged in this case, so that the two supporting levers 6 and the control lever 7 are coupled to one another both in the region of the housing 5 and also on the attachment 9. The third gear wheel 13, which rotates the control disk 15, is also driven by the rotation of the gear wheel 10. By rotating the control disk 15, the curve guide 16 is moved, which enables a contraction of the springs 21 of the force accumulator 20 during an opening movement after overcoming the dead center, so that the force accumulator 20 assists the opening procedure.

Figure 8:
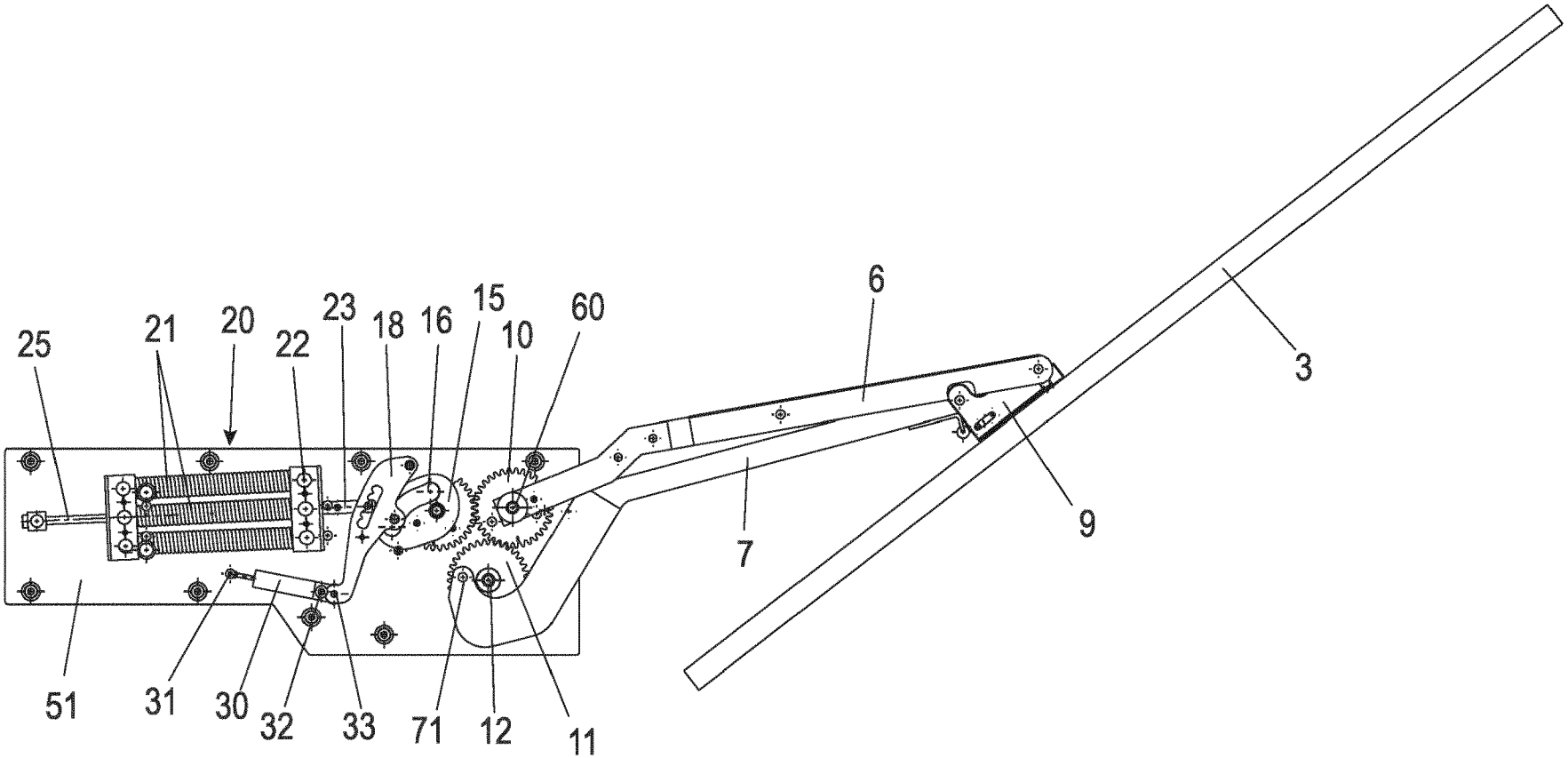

The flap 3 is moved further in the opening direction according to FIG. 8, wherein an upper end of the flap 3 protrudes forward and upward. A lower region of the flap moves essentially vertically upward shortly before the opening on the furniture body 2.

Figure 9:
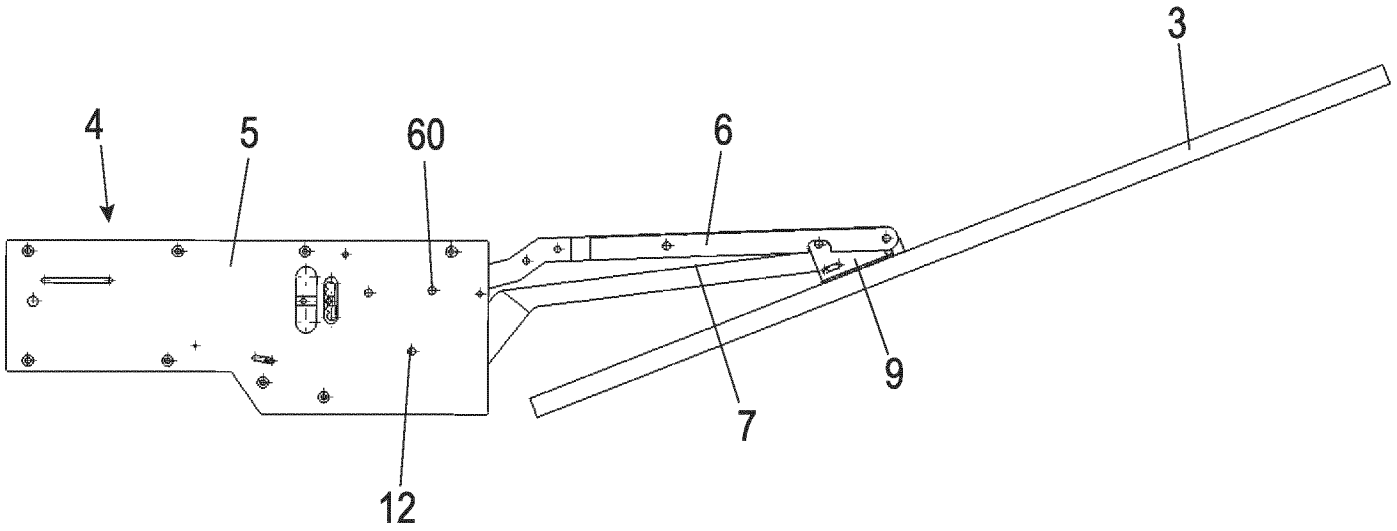
FIG. 9 shows a view of the flap fitting in an open position.

The maximally open position of the flap fitting 4 is shown in FIG. 9. The flap 3 is inclined slightly in relation to the horizontal, for example, in a range between 10° and 20°, and largely exposes the opening region on the furniture body 2. Before reaching the maximally open position, the opening movement can be decelerated, for example, by a damper, which is arranged in the attachment 9. Alternatively, or additionally, the damper 30 is provided in the housing 5, which is compressed by the actuating element 33 on the holder 18, as shown in FIG. 8.

For a closing movement, the user pulls the flap 3 downward against the force of the force accumulator 20 until the flap 3 is again arranged in the closed position illustrated in FIG. 5.

In the illustrated exemplary embodiment, three gear wheels 10, 11, and 13 are arranged in the housing 5. It is also possible to provide a gearing having a predetermined transmission ratio in the housing 5 in order to adapt the tensioning and release of the force accumulator 20 still more strongly to the weight of the flap 3 and other parameters.

Figure 10:
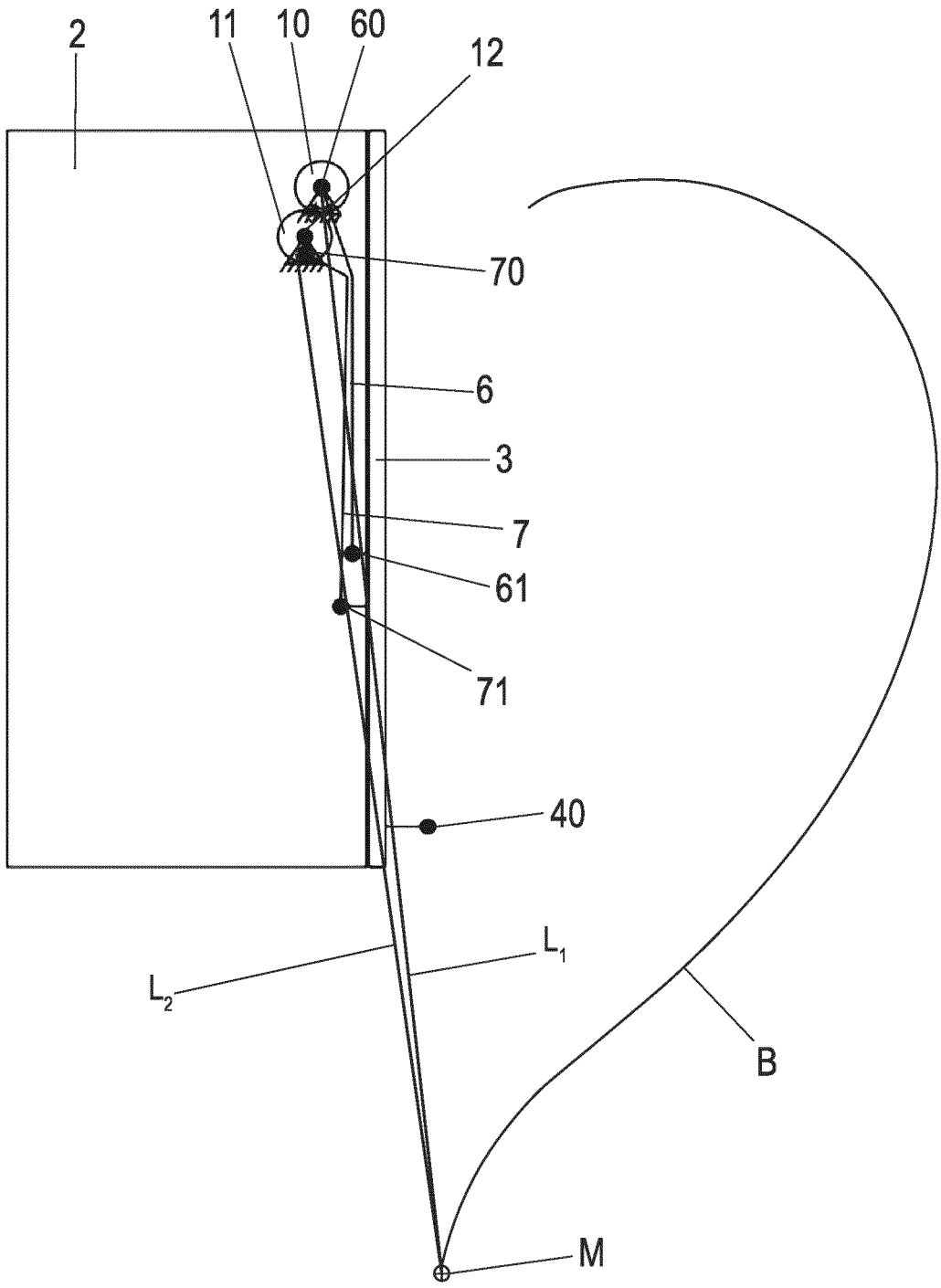
FIGS. 10 to 13 show schematic views of an item of furniture having a flap fitting according to the invention, in which the path of the instantaneous center of rotation of the axes of rotation on the attachment of the flap is shown.
Figure 11:
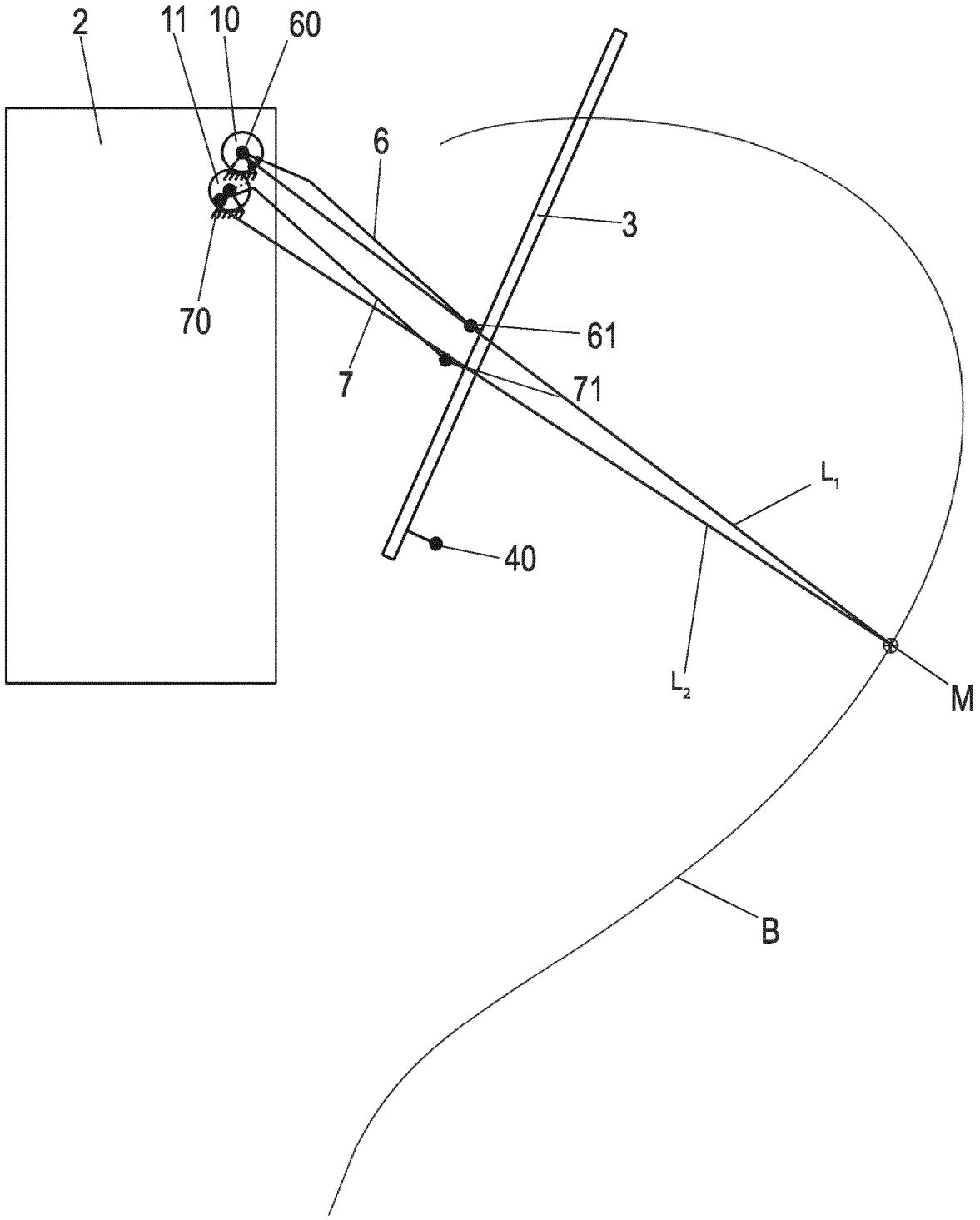

The kinematic of the flap fitting 4 according to the invention is schematically illustrated in FIGS. 10 to 13. In FIG. 10, the flap 3 is shown in a closed position, and the supporting lever 6 and the control lever 7 are arranged inside the furniture body 2, wherein the supporting lever 6 is rotatably mounted around a stationary axis of rotation 60 together with the gear wheel 10 formed as a control element. The control lever 7 is mounted around an axis of rotation 70, which changes during the opening movement of the flap 3 and is rotatable on a gear wheel 11 in the illustrated exemplary embodiment. However, it is also possible to provide the axis of rotation 70 on a joint lever instead of on a gear wheel 11. Moreover, the supporting lever 6 is rotatably mounted via an axis of rotation 61 and the control lever 7 is rotatably mounted via an axis of rotation 71 on an attachment on an inner side of the flap 3, wherein the attachment 9 can alternately be formed in one or multiple parts. Furthermore, a handle element 40 is also shown in FIG. 10, which is installed on an outer side of the flap 3 in a lower region, wherein a handle section of the handle element 40 is arranged above a lower end edge of the plate-shaped flap 3.

Alternatively, the handle element 40 can also be arranged on the end face of the flap 3, for example, in the form of a profile rail, preferably having an engagement option or an undercut.

Figure 12:
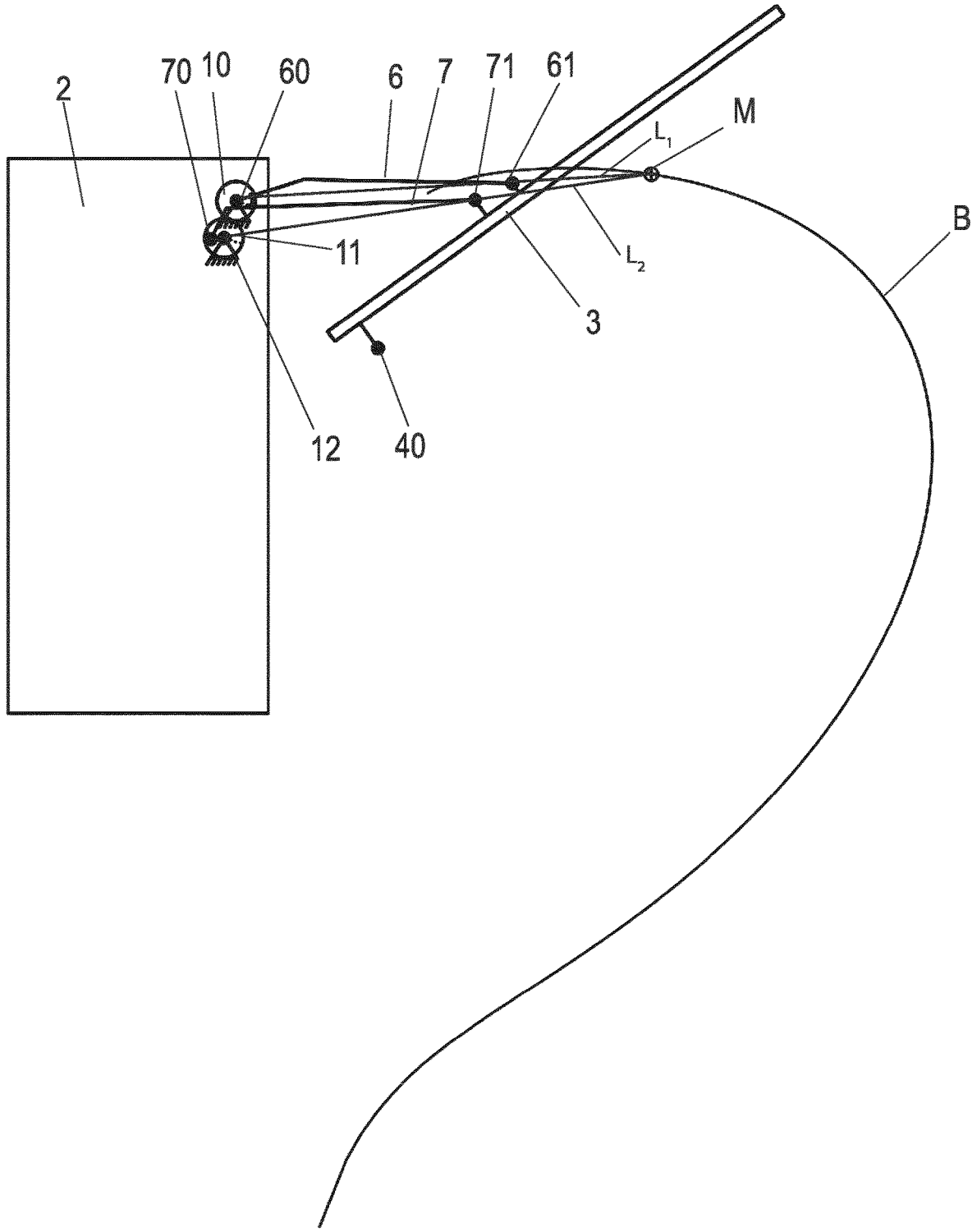

The intersection point of the first connecting line L1, which connects the axis of rotation 60 and 61, and the second connecting line L2, which connects the axis of rotation 70 and 71, denotes the instantaneous center of rotation M of the flap 3, which extends from a closed position into a maximally open position along a path B which is stationary in relation to the furniture body 2. The instantaneous center of rotation is provided in this case spaced apart from the handle element 40 in every open position, so that jamming can be reliably avoided during an opening or closing movement. The distance of the handle element 40 from the instantaneous center of rotation M is greater in the closed position of the flap 3 than the length of the supporting lever 6. If the flap 3 is now moved by the handle element 40 in the opening direction, the flap 3 arrives in a position illustrated in FIG. 11. The instantaneous center of rotation M has traveled upward and toward a front side, wherein the distance of the instantaneous center of rotation M from the handle element 40 is still greater than the length of the supporting lever 6. During a further opening movement, the instantaneous center of rotation M moves farther upward, as shown in FIG. 12. In this position, the instantaneous center of rotation M is already arranged above the handle element 40, wherein the instantaneous center of rotation M hardly still extends vertically in this opening range, but rather essentially horizontally toward the furniture body 2.

Figure 13:
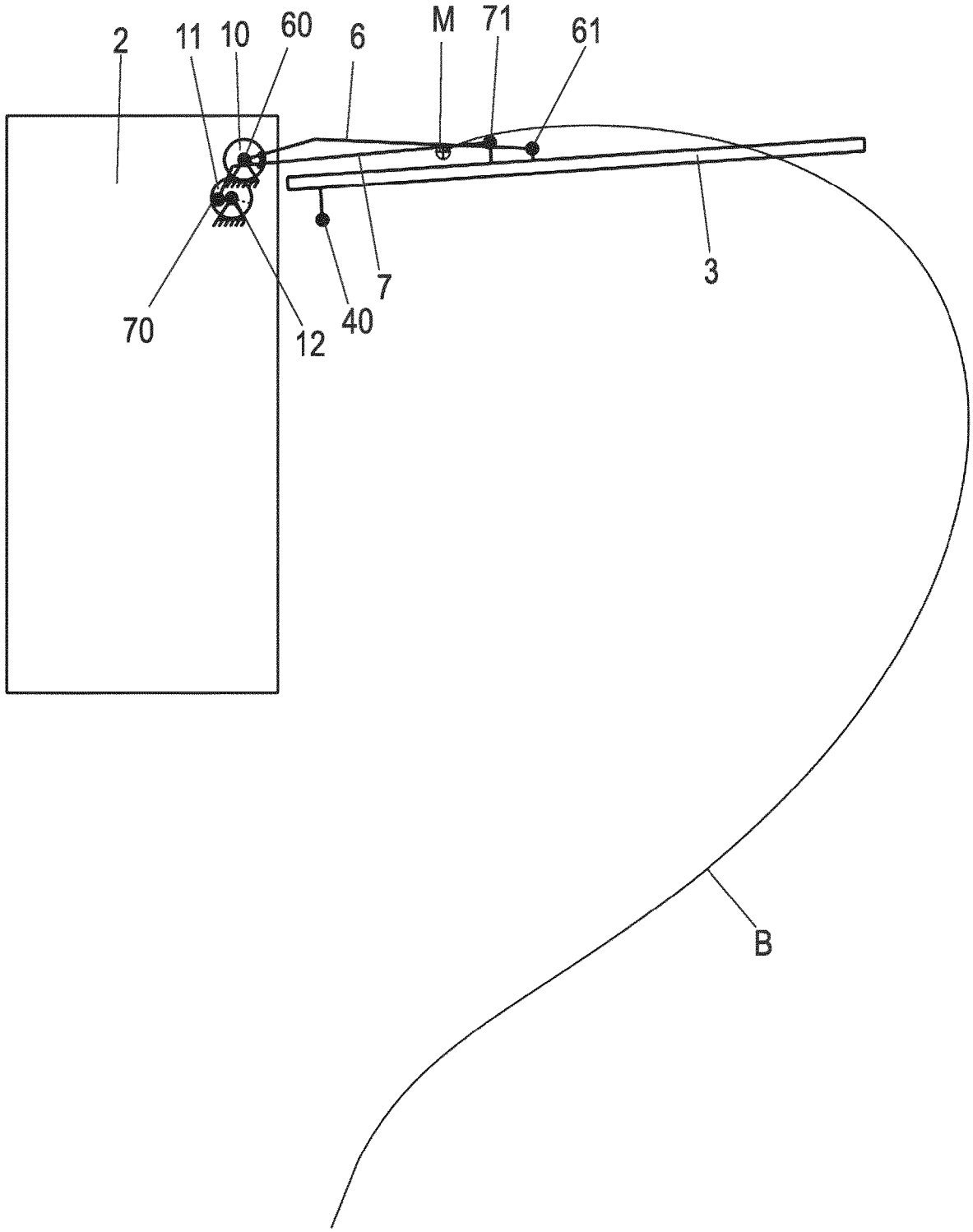

The maximally open position of the flap 3 is shown in FIG. 13. The instantaneous center of rotation M has no longer been moved upward in the last opening range, but rather drops slightly along the path B and only still moves toward the furniture body 2. The distance of the instantaneous center of rotation M from the axis of rotation 60 is also greater than the distance of the handle element 40 from the axis of rotation 60 in the maximally open position. This is fulfilled for the entire opening range of the flap 3, wherein the distance of the instantaneous center of rotation M from the axis of rotation 60 is preferably greater by at least 20%, in particular at least 40% than the distance of the handle element 40 from the axis of rotation 60, to ensure smooth movement.

The flap fitting 4 has a kinematic self-inhibition from a certain opening angle of the flap 3, i.e., the flap 3 remains standing in an end position even without spring assistance from a certain opening angle.

As the kinematic of FIGS. 10 to 13 shows, the flap 3 can be opened with a slight horizontal force until the assistance by the force accumulator 20 engages and the flap 3 opens further with spring assistance. For the closing procedure, the user then has to pull the handle element 40 downward until the force of the force accumulator 20 is overcome and the flap is then drawn automatically into the closed position via the force accumulator.

Figure 14:
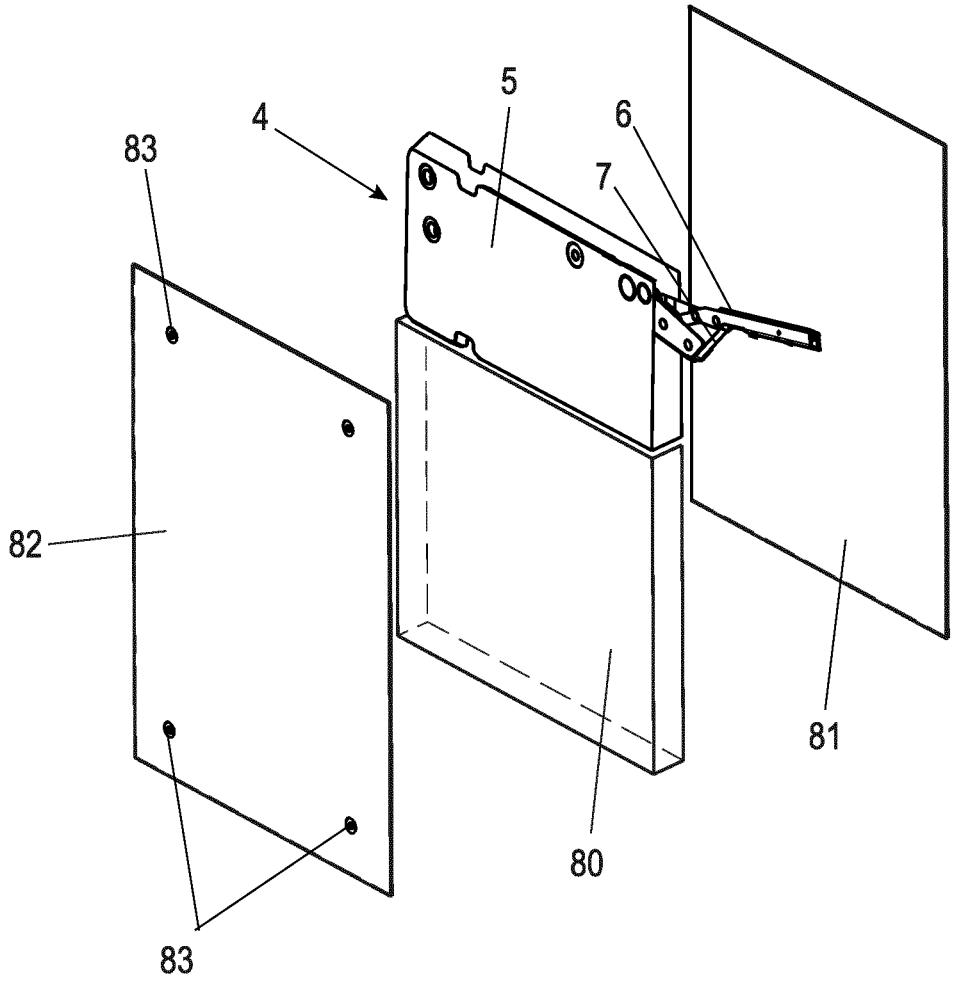
FIG. 14 shows a view of a modified flap fitting which is arranged in a side wall of an item of furniture.

A flap fitting 4 is fastened on an inner side of a side wall of a furniture body 2 in each of FIGS. 1 to 9. In FIG. 14, the flap fitting 4 is not integrated on an inner side but rather in a side wall of the furniture body 2. For this purpose, the side wall comprises a plate-shaped core material 80, for example, made of a wooden material, adjacent to which the housing 5 of the flap fitting 4 is arranged, either over the entire width of the core material 80 or on a recess of the core material 80 which extends over only a part of the width of the core material 80. The housing 5 and the core material 80 are covered on the outer side by an outer layer 81 and on the inner side via an inner layer 82, wherein outer layer 81 and inner layer 82 can optionally also be embodied as structurally equivalent, for example, from a film or a decorative layer. In the illustrated exemplary embodiment, the inner layer 82 is fixed via fastening points on the core material 80 and the housing 5. The housing 5 can be adhesively bonded to the core material 5 or connected via fastening means. Due to the arrangement of the housing in the side wall of a furniture body, the housing is only visible from an end face with open flap 3 when the supporting lever 6 and the control lever 7 protrude forward.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

1 item of furniture
2 furniture body
3 flap
4 flap fitting
5 housing
6 supporting lever
7 control lever
8 rod
9 attachment
10 gear wheel
11 gear wheel
12 axis of rotation
13 gear wheel
14 axis of rotation
15 control disk
16 curve guide
17 guide element
18 holder
19 receptacle
20 force accumulator
21 spring
22 spring holder
23 rod
24 spring holder
25 fastening
30 damper
31 fastening element
32 contact surface
33 actuating element
40 handle element
50 side wall
51 side wall
52 spacer
60 axis of rotation
61 axis of rotation
70 axis of rotation
71 axis of rotation
80 core material
81 outer layer
82 inner layer
83 fastening points
B web
M instantaneous center of rotation
L1 first connecting line
L2 second connecting line

The invention claimed is:

1. A flap fitting for an item of furniture, wherein the flap fitting comprises:

a main body;

a supporting lever rotatably mounted around a first axis of rotation on the main body, wherein the supporting lever is connectable via a second axis of rotation to a flap of the item of furniture using an attachment; and a control lever connectable via a third axis of rotation via the attachment to the flap of the item of furniture, wherein the control lever is articulated via a fourth axis of rotation with a control element and the main body, and the flap of the item of furniture is pivotable via a handle, wherein an instantaneous center of rotation of the flap of the item of furniture is arranged, in a closed position of the flap of the item of furniture, below the handle, and wherein the instantaneous center of rotation of the flap of the item of furniture is arranged, in a maximally open position of the flap of the item of furniture, above the handle, and wherein a path of the instantaneous center of rotation, during an opening movement of the flap of the item of furniture, initially extends upward in a curve and sinks shortly before reaching the maximally open position.

2. The flap fitting of claim 1, wherein a path of the instantaneous center of rotation extends spaced apart from the handle during an opening movement of the flap of the item of furniture.

3. The flap fitting of claim 1, wherein, in the closed position of the flap of the item of furniture, a distance from the handle to the instantaneous center of rotation is greater than a length of the supporting lever.

4. The flap fitting of claim 1, wherein a distance of the instantaneous center of rotation from the handle over an entire path of the instantaneous center of rotation during an opening movement is at least 50% of a distance of the handle from the first axis of rotation.

5. The flap fitting of claim 1, wherein the control element is a gear wheel.

6. The flap fitting of claim 5, wherein the gear wheel is engaged with a further gear wheel, wherein the further gear wheel is arranged in a rotationally-fixed manner with the supporting lever around the first axis of rotation.

7. The flap fitting of claim 1, further comprising:

a force accumulator configured to pretension the flap of the item of furniture in a closed position and/or to pretension the flap of the item of furniture in an opening range in an opening direction.

8. The flap fitting of claim 1, further comprising:

at least one damper configured to decelerate an opening and/or closing movement of the flap of the item of furniture before reaching an end position.

9. The flap fitting of claim 1, wherein the handle of the flap of the item of furniture faces downward in a direction of the operator in an open position of the flap of the item of furniture.

10. A flap fitting for an item of furniture, wherein the flap fitting comprises:

a main body;

a supporting lever rotatably mounted around a first axis of rotation on the main body, wherein the supporting lever is connectable via a second axis of rotation to a flap of the item of furniture using an attachment;

a control lever connectable via a third axis of rotation via the attachment to the flap of the item of furniture, wherein the control lever is articulated via a fourth axis of rotation with a control element and the main body, and the flap of the item of furniture is pivotable via a handle;

a force accumulator configured to pretension the flap of the item of furniture in a closed position and/or to pretension the flap of the item of furniture in an opening range in an opening direction, wherein an instantaneous center of rotation of the flap of the item of furniture is arranged, in a closed position of the flap of the item of furniture, below the handle, and wherein the instantaneous center of rotation of the flap of the item of furniture is arranged, in a maximally open position of the flap of the item of furniture, above the handle, wherein the force accumulator is coupled via a rotatably mounted control disk to a gear wheel, which is drivable by pivoting the flap of the item of furniture.

11. The flap fitting of claim 10, wherein a path of the instantaneous center of rotation, during an opening movement of the flap of the item of furniture, initially extends upward in a curve and sinks shortly before reaching the maximally open position and wherein a path of the instantaneous center of rotation extends spaced apart from the handle during an opening movement of the flap of the item of furniture.

12. The flap fitting of claim 10, wherein, in the closed position of the flap of the item of furniture, a distance from the handle to the instantaneous center of rotation is greater than a length of the supporting lever.

13. The flap fitting of claim 10, wherein the control element is a gear wheel.

14. The flap fitting of claim 13, wherein the gear wheel is engaged with a further gear wheel, wherein the further gear wheel is arranged in a rotationally-fixed manner with the supporting lever around the first axis of rotation.

15. The flap fitting of claim 10, further comprising:

at least one damper configured to decelerate an opening and/or closing movement of the flap of the item of furniture before reaching an end position.

16. The flap fitting of claim 10, wherein the handle of the flap of the item of furniture faces downward in a direction of the operator in an open position of the flap of the item of furniture.

17. An item of furniture, comprising:

a body;

a flap pivotably mounted on the body;

two flap fittings coupling the flap to the body, wherein each of the two flap fittings comprise a main body;

a supporting lever rotatably mounted around a first axis of rotation on the main body, wherein the supporting lever is connectable via a second axis of rotation to the flap of the item of furniture using an attachment; and a control lever connectable via a third axis of rotation via the attachment to the flap, wherein the control lever is articulated via a fourth axis of rotation with a control element and the main body, and the flap is pivotable via a handle, wherein an instantaneous center of rotation of the flap is arranged, in a closed position of the flap, below the handle, and wherein the instantaneous center of rotation of the flap is arranged, in a maximally open position of the flap of the item of furniture, above the handle, and wherein a path of the instantaneous center of rotation, during an opening movement of the flap of the item of furniture, initially extends upward in a curve and sinks shortly before reaching the maximally open position.

18. The item of furniture of claim 17, further comprising:

a force accumulator configured to pretension the flap of the item of furniture in a closed position and/or to pretension the flap of the item of furniture in an opening range in an opening direction, wherein the force accumulator is coupled via a rotatably mounted control disk to a gear wheel, which is drivable by pivoting the flap of the item of furniture.

19. An item of furniture, comprising:

a body;

a flap pivotably mounted on the body;

two flap fittings coupling the flap to the body, wherein each of the two flap fittings comprise a main body;

a supporting lever rotatably mounted around a first axis of rotation on the main body, wherein the supporting lever is connectable via a second axis of rotation to the flap of the item of furniture using an attachment; and a control lever connectable via a third axis of rotation via the attachment to the flap, wherein the control lever is articulated via a fourth axis of rotation with a control element and the main body, and the flap is pivotable via a handle, a force accumulator configured to pretension the flap of the item of furniture in a closed position and/or to pretension the flap of the item of furniture in an opening range in an opening direction, wherein an instantaneous center of rotation of the flap is arranged, in a closed position of the flap, below the handle, and wherein the instantaneous center of rotation of the flap is arranged, in a maximally open position of the flap of the item of furniture, above the handle, and wherein the force accumulator is coupled via a rotatably mounted control disk to a gear wheel, which is drivable by pivoting the flap of the item of furniture.

20. The item of furniture of claim 19, wherein a path of the instantaneous center of rotation, during an opening movement of the flap of the item of furniture, initially extends upward in a curve and sinks shortly before reaching the maximally open position and wherein a path of the instantaneous center of rotation extends spaced apart from the handle during an opening movement of the flap of the item of furniture.

* * * * *